US007804482B2

(12) United States Patent
Hsu et al.

(10) Patent No.: US 7,804,482 B2
(45) Date of Patent: Sep. 28, 2010

(54) LCD AND BACKLIGHT MODULE THEREOF

(75) Inventors: Ming-Chun Hsu, Hsin-Chu (TW); Fu-Tung Chen, Hsin-Chu (TW); Chien-Hung Chen, Hsin-Chu (TW); Hong-Jye Hong, Hsin-Chu (TW); Chih-Kang Wu, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 395 days.

(21) Appl. No.: 12/115,792

(22) Filed: May 6, 2008

(65) Prior Publication Data

US 2009/0243500 A1 Oct. 1, 2009

(30) Foreign Application Priority Data

Mar. 26, 2008 (TW) ..... 97110846 A

(51) Int. Cl.
*G09G 3/36* (2006.01)

(52) U.S. Cl. ..... 345/102; 315/210; 315/224; 315/299; 315/312

(58) Field of Classification Search ..... 345/102; 315/210, 224, 225, 226, 291, 299, 307, 312
See application file for complete search history.

(56) References Cited

U.S. PATENT DOCUMENTS 6,429,839 B1 * 8/2002 Sakamoto ..... 345/87
6,822,398 B2 11/2004 Murr et al.
7,113,163 B2 * 9/2006 Nitta et al. ..... 345/102
7,391,167 B2 * 6/2008 Jang et al. ..... 315/291
2004/0257793 A1 12/2004 Wakabayashi
2005/0111237 A1 5/2005 Moon et al.
2005/0116662 A1 * 6/2005 Sanchez ..... 315/225
2006/0023470 A1 2/2006 Chen et al.
2006/0055660 A1 * 3/2006 Teranishi ..... 345/102
2006/0158132 A1 * 7/2006 Jang ..... 315/209 R
2007/0115688 A1 * 5/2007 Yang et al. ..... 362/614
2007/0152951 A1 7/2007 Ahn
2007/0242477 A1 10/2007 Yoo et al.
2008/0002096 A1 * 1/2008 Lee ..... 349/64

FOREIGN PATENT DOCUMENTS

TW 288235 10/2007

OTHER PUBLICATIONS

English language translation of abstract of TW 288235.

* cited by examiner

*Primary Examiner*—Thuy Vinh Tran
(74) *Attorney, Agent, or Firm*—Thomas, Kayden, Horstemeyer & Risley, LLP

(57) ABSTRACT

A backlight module includes fluorescent lamps, an inverter for supplying power for the lamps, dimming circuits each connecting the lamp in series, a signal processor for converting a video signal into a dimming signal, and a control unit. The lamps are disposed as an array having more than two columns and two rows on a substrate. The control unit electrically connects the signal processor and the dimming circuit and changes the luminance of the lamps by adjusting the dimming circuit according to the dimming signal.

18 Claims, 3 Drawing Sheets

LCD AND BACKLIGHT MODULE THEREOF

RELATED APPLICATIONS

This application claims priority to Taiwan Application Serial Number 97110846, filed Mar. 26, 2008, which is herein incorporated by reference.

BACKGROUND

1. Field of Invention

The present invention relates to a display. More particularly, the present invention relates to a backlight module for the display.

2. Description of Related Art

A liquid crystal display (referred as to LCD) is a thin, flat display device and uses very small amounts of electric power. The LCD has been widely used in all kinds of electronic devices such as cell phones, personal digital assistant, cameras, computer monitors, etc. Contrast ratio is one of the important quality factors of the LCD. It is defined by the ratio of the luminance of the brightest color like white to the luminance of the darkest color like black. In general, when displaying high definition video, the LCD requires thousands of different luminance to present colors of an image precisely. Therefore, the LCD manufactures attend to upgrading the contrast ratio of the LCD.

In modern technology, one of the methods to raise the contrast ratio of the LCD is the local dimming technology, which is to dim each light source individually in a backlight module of the LCD by adjusting current flowing through each light source.

The light source for the backlight module can be a fluorescent lamp or a light emitting diode (referred to as LED). Due to the recent technology, the fluorescent lamps may only be arranged parallel to each other, which means the fluorescent lamps only arranged in one direction. Therefore, the luminance variation is in one dimension, which is the direction the fluorescent lamps are arranged in, and is not sufficient for a two dimensional image that is displayed on the LCD. On the other hand, the LED may be arranged as a two dimensional array to match up the two-dimensional displaying image. However, currently, the price for a backlight module with LED is much higher. When the size of the LCD gets bigger, the price gap gets higher.

In the foregoing, a new display and a backlight module thereof is needed. The new display may use fluorescent lamps and may achieve two-dimensional local dimming at the same time to answer the industrial need and to benefit economic interests.

SUMMARY

A backlight module is provided. The backlight module may use fluorescent lamps to achieve dimming in two dimensions. The backlight module has fluorescent lamps disposed on a substrate. The fluorescent lamps are arranged to form an array having more than two columns and two rows. An inverter electrically connects the fluorescent lamps to supply power for the fluorescent lamps.

The backlight module further has dimming circuits, a signal processor and a control unit. Each dimming circuit is electrically connected to one fluorescent lamp in series and can be varied to adjust the current flowing through the fluorescent lamp connected in series. The signal processor is operable for converting a video signal into a dimming signal. The control unit electrically connects the dimming circuits and the signal processor. The control unit receives the dimming signal, and switches the dimming circuits to adjust the current according to the dimming signal, and consequently, to change the luminance of the fluorescent lamps.

In the foregoing, the fluorescent lamps are arranged in the two dimensional array. Each of the fluorescent lamps can be dimmed individually. Therefore, two-dimensional dimming can be achieved.

The invention also provides a display to break the limitation of one-dimensional dimming of the backlight module with fluorescent lamps. The display has a panel and a backlight module. The panel includes a plurality of display areas arranged to from a matrix, wherein the matrix has more than two columns and two rows. The backlight module is arranged in series with the panel and has a substrate and a plurality of fluorescent lamps. The fluorescent lamps are disposed on the substrate and arranged to form an array having more than two columns and two rows. The array is aligned with the matrix, which means at least one fluorescent lamp is arranged in series with one display area.

The backlight module further includes an inverter, a plurality of dimming circuits, a signal processor, and a control unit. The signal processor converts a video signal into a dimming signal. The inverter electrically connects the fluorescent lamps to supply power for the fluorescent lamps. Each dimming circuit is electrically connected to one fluorescent lamp in series and can be varied to adjust the current flowing through the fluorescent lamp connected in series. The control unit electrically connects the dimming circuits and the signal processor. The control unit switches the dimming circuits individually to adjust the current flowing through the series connected fluorescent lamp according to the dimming signal to change the luminance of the fluorescent lamp. In the foregoing, the array of the fluorescent lamps co-operates with the panel to achieve the two dimensional local dimming.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
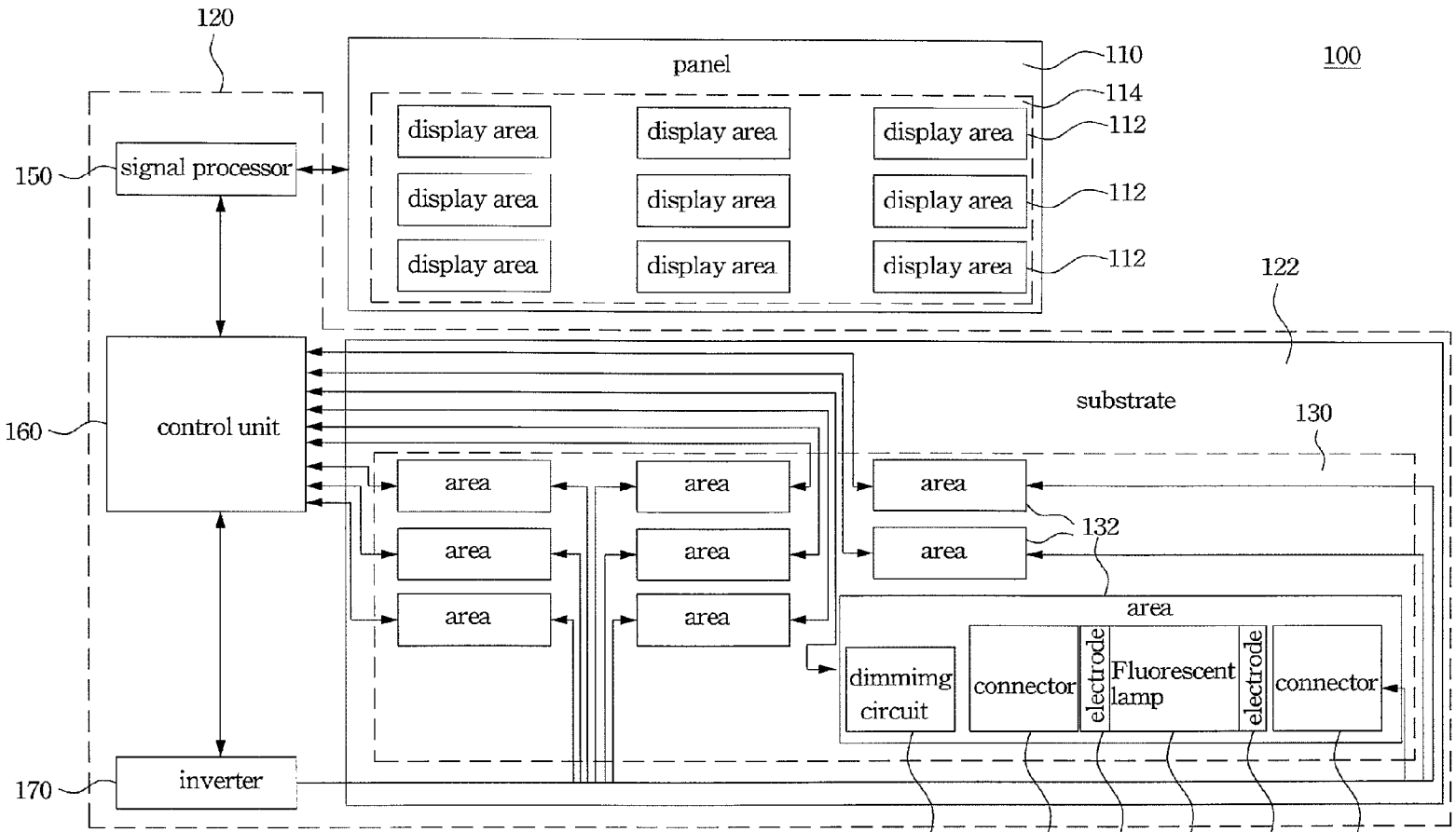
FIG. 1 is a block diagram of a display according to one embodiment of this invention.

Reference will now be made in detail to the present embodiments of the invention, examples of which are illustrated in the accompanying drawings. Wherever possible, the same reference numbers are used in the drawings and the description to refer to the same or like parts.

Please refer to FIG. 1. FIG. 1 is a block diagram of a display 100 according to one embodiment of this invention. The display 100 has a panel 110 and a backlight module 120. The panel 110 includes a plurality of display areas 112 disposed on a surface of the panel 110. The display areas 112 are arranged to from a two-dimensional matrix 114, wherein both the number of columns and rows of the matrix 114 are more than two.

The backlight module 120 is arranged in series with the panel 110. In the embodiment of this invention, the panel 110 is placed in front of the backlight module 120, which means the backlight module 120 is a direct type of backlight. The light source of the backlight module 120 is a plurality of fluorescent lamps 140. The fluorescent lamps 140 are disposed on a substrate 122 and arranged to form an array 130 having more than two columns and two rows.

An inverter 170 electrically connects the fluorescent lamps 140 to supply power to the fluorescent lamps 140. Each fluorescent lamp 140 is electrically connected in series to one dimming circuit 180, which can be varied to adjust the current flowing through the series connected fluorescent lamp 140.

The backlight module 120 further includes a signal processor 150 and a control unit 160. The control unit 160 electrically connects the dimming circuits 180 and the signal processor 150. The signal processor 150 converts a video signal into a dimming signal, and transmits the dimming signal to the control unit 160. The control unit 160 switches the dimming circuit 180 one by one to adjust the current flowing through the series connected fluorescent lamp 140 according to the dimming signal, so that the luminance of each fluorescent lamp 140 may be changed individually. Therefore, the two dimensional local dimming can be achieved using the array 130 of fluorescent lamps 140. Each element will be described in detail as follows.

Those skilled in this art know that the local dimming may be done in two different methods: linear dimming and pulse-width modulation (referred as to PWM). The linear dimming method is to modulate the amount of electrical current flowing through the fluorescent lamp 140 to change the luminance of the fluorescent lamp 140. PWM modulates the pulse-width to change the duty of the current flowing through the fluorescent lamp 140 to change the luminance of the fluorescent lamp 140. More specifically, the current flowing through the fluorescent lamp 140 has periodical pulses. Each pulse has a high voltage part and a low voltage part, wherein the voltage of the low voltage part is smaller than the voltage of the high voltage part. The high voltage part is for driving the fluorescent lamp 140 to radiate. The duty is a ratio of the time of the high voltage part to the time of the pulse. In other word, the duty shows how long the fluorescent lamp 140 is driven to radiate in the time period of each pulse. Those skilled in this art familiar with the detail of PWM, therefore, it won't be described redundantly here.

The array 130 can be divided into many areas 132. Each area 132 has at least one fluorescent lamp 140. Although FIG. 1 shows one fluorescent lamp 140 in each area 132, the number of fluorescent lamps 140 can be many.

The array 130 is aligned with the matrix 114, which means each area 132 is arranged in series with one display area 112. In the embodiment of this invention, the area 132 is arranged behind each display area 112. Therefore, each display area 112 is in front of at least one fluorescent lamp 140.

In addition, the panel 110 electrically connects the signal processor 150. The panel 110 may change the transmittance of each display area 112 thereon according to the dimming signal. The luminance of the display area 112 presented may be modulated according to the image.

Each fluorescent lamp 140 has two electrodes 146. In the embodiment of this invention, two connectors 134 fasten two ends of the fluorescent lamp 140 respectively on the substrate 122. The electrode 146 electrically connects the connector 134. Since the fluorescent lamps 140 are arranged in the array 130, at least one electrode 134 of each fluorescent lamp 140 must be located on the substrate 122, right behind the panel 110, instead of the edge of the substrate 122. Because the electrode 146 does not radiate light, the electrode 146 has to be arranged right next to the adjacent fluorescent lamp 140 in order not to create a dark spot on the panel 110. It can be more fully understood by the following detailed description of the embodiment.

Figure 2:
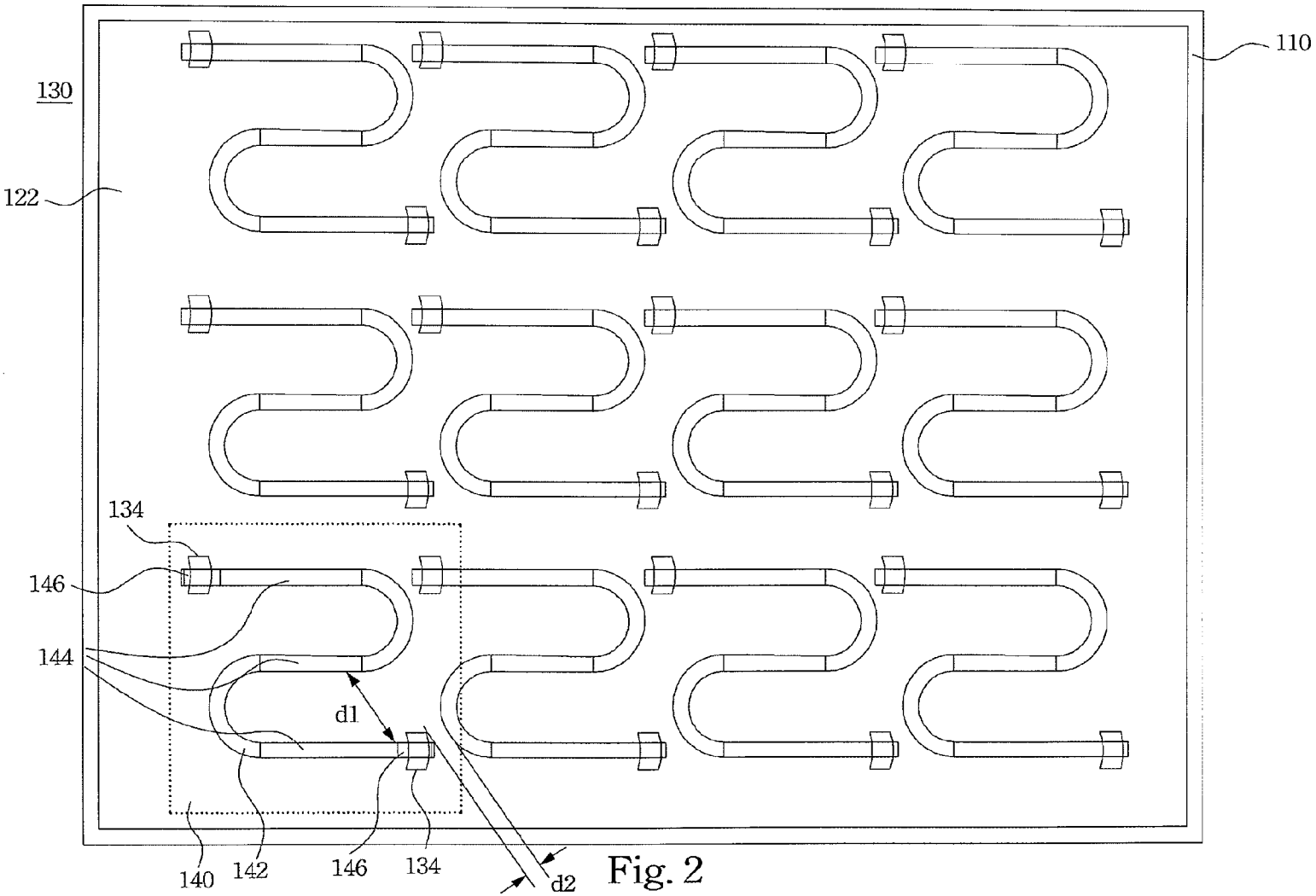
FIG. 2 is a top view of an array of fluorescent lamps according to one embodiment of this invention.

Please refer to FIG. 2. FIG. 2 is a top view of an array 130 of fluorescent lamps 140 according to one embodiment of this invention. In the embodiment of this invention, the fluorescent lamps 140 are bent tubes. The shape of each fluorescent lamp 140 is S-shape, which means each fluorescent lamp 140 comprises two bent parts 142 and three straight parts 144. Each end of the bent parts 142 connects to one straight part 144. The electrode 146 connects the end of the straight part 144. The three straight parts 144 are parallel to each other. In general, there is a gap between two adjacent fluorescent lamps 140, and also there is a gap between two adjacent straight parts 144. Those skilled in this art knows light guide plates like diffuser (not shown) may direct light from the fluorescent lamps 140 uniformly over the entire penal 110, which may cover the part of the penal 110 right in front of the gap, which does not radiate.

Similarly, since the electrode 146 does not radiate either, the electrode 146 may be arranged next to the fluorescent lamp 140 nearby. The diffuser may direct light from the fluorescent lamps 140 uniformly to cover the part of the panel 110 in front of the electrode 146. More specifically, the electrode 146 and the adjacent straight part 144 of the fluorescent lamp 140 have a minimal distance d1. Within two adjacent fluorescent lamps 140, the electrode 146 of one fluorescent lamp 140 and the bent part 146 of the other fluorescent lamp 140 have a minimal distance d2. The minimal distance d2 is smaller than the minimal distance d1. Therefore, the light radiated from the bent part 146 may cover the electrode 146, which may prevent a dark spot forming on the panel 110.

Figure 3:
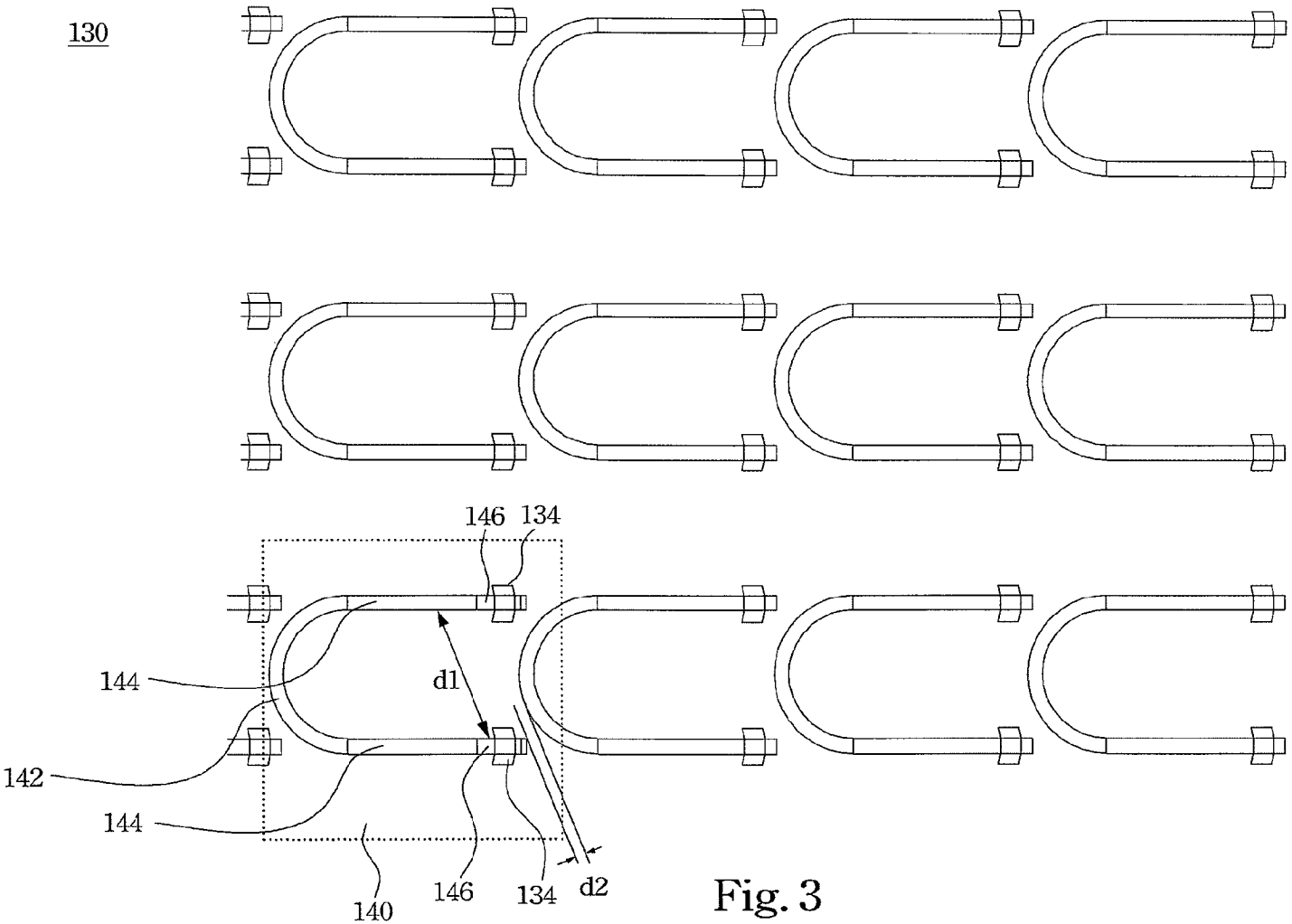
FIG. 3 is a top view of an array of fluorescent lamps according to another embodiment of this invention.

Please refer to FIG. 3. FIG. 3 is a top view of an array 130 of fluorescent lamps 140 according to another embodiment of this invention. In the embodiment of this invention, the shape of each fluorescent lamp 140 is U-shaped, which means each fluorescent lamp 140 comprises one bent part 142 and two straight parts 144. One end of the straight part 144 connects the bent part 142 and the other end of the straight part 144 connects the electrode 146. As the above, a minimal distance d1 between the electrode 146 and the adjacent straight part 144 of the fluorescent lamp 140 is bigger than a minimal distance d2 between the electrode 146 of the fluorescent lamp 140 and the bent part 146 of the adjacent fluorescent lamp 140.

Please notice that the shape of the fluorescent lamp 140 shown in FIG. 2 and FIG. 3 are examples, and should not be limited to the U-shape or the S-shape. In fact, the shape of the fluorescent lamp 140 may be a straight tube, or a bent tube, such as U-shape, S-shape, and W-shape, etc.

Although the present invention has been described in considerable detail with reference certain embodiments thereof, other embodiments are possible. Therefore, their spirit and scope of the appended claims should no be limited to the description of the embodiments container herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A backlight module, comprising:

a plurality of fluorescent lamps arranged to form an array having more than two columns and two rows on a substrate;

an inverter electrically connecting the fluorescent lamps to supply power to the fluorescent lamps;

a plurality of dimming circuits each electrically connecting one of the fluorescent lamps in series and being variable to adjust current flowing through the fluorescent lamp connected in series;

a signal processor being operable for converting a video signal into a dimming signal; and a control unit electrically connecting the dimming circuits and the signal processor, the control unit being operable for switching the dimming circuits to adjust the current according to the dimming signal to change the luminance of the fluorescent lamps.

2. The backlight module of claim 1, wherein the fluorescent lamps are bent tubes.

3. The backlight module of claim 2, wherein each of the fluorescent lamps comprises:

a plurality of straight parts parallel to each others; and at least one bent part, both ends of the bent part being connected to the straight parts respectively.

4. The backlight module of claim 3, wherein each of the fluorescent lamps comprises an electrode, the electrode connecting one of the straight parts and having a first minimal distance from other straight parts.

5. The backlight module of claim 4, wherein within two adjacent fluorescent lamps, the electrode of each fluorescent lamp has a second minimal distance from the bent part of the other fluorescent lamp, wherein the second minimal distance is smaller than the first minimal distance.

6. The backlight module of claim 2, wherein the fluorescent lamps are U-shape or S-shape.

7. The backlight module of claim 1, wherein the current comprises:

a plurality of high voltage parts for driving the fluorescent lamps to radiate; and a plurality of low voltage parts arranged alternately with the high voltage parts, the voltage of the low voltage parts being smaller than the voltage of the high voltage parts.

8. The backlight module of claim 1, wherein the dimming circuit is variable to change the duty of the current.

9. The backlight module of claim 1, further comprising a plurality of connectors disposed on the substrate, each connector connecting the electrode of the fluorescent lamps respectively.

10. A display, comprising:

a panel having a plurality of display areas arranged to from a matrix having more than two columns and two rows;

a backlight module disposed below the panel, comprising:

a plurality of fluorescent lamps arranged to form an array having more than two columns and two rows on a substrate, the array being aligned to the matrix;

an inverter electrically connecting the fluorescent lamps to supply power for the lamps;

a plurality of dimming circuits each electrically connecting one of the fluorescent lamps in series and being variable to adjust current flowing through the fluorescent lamp connected in series;

a signal processor, being operable for converting a video signal into a dimming signal; and a control unit, electrically connecting the dimming circuits and the signal processor, the control unit being operable for switching the dimming circuits to adjust the current according to the dimming signal to change the luminance of the fluorescent lamps.

11. The display of claim 10, wherein the fluorescent lamps are bent tubes.

12. The display of claim 11, wherein each of the fluorescent lamps comprises:

a plurality of straight parts parallel to each other; and at least one bent part, both ends of the bent part being connected to the straight parts respectively.

13. The display of claim 12, wherein each of the fluorescent lamps comprises an electrode, the electrode connecting one of the straight part and having a first minimal distance from another straight parts.

14. The display of claim 13, wherein within two adjacent fluorescent lamps, the electrode of each fluorescent lamp has a second minimal distance from the bent part of the other fluorescent lamp, wherein the second minimal distance is smaller than the first minimal distance.

15. The display of claim 11, wherein the fluorescent lamps are U-shape or S-shape.

16. The display of claim 10, wherein the panel electrically connecting the signal processor, each display area being operable for changing the transmittance thereof according to the dimming signal.

17. The display of claim 10, wherein the dimming circuit is variable to change the duty of the current.

18. The display of claim 10, wherein the current having at least one high voltage part for driving the fluorescent lamps to radiate.

* * * * *